US007438181B2

(12) United States Patent
Cuomo

(10) Patent No.: US 7,438,181 B2
(45) Date of Patent: Oct. 21, 2008

(54) CARRIER AND METHOD

(75) Inventor: Angelo V. Cuomo, Staten Island, NY (US)

(73) Assignee: E-Z Media, Inc., New York, NY (US)

( * ) Notice: Subject to any disclaimer, the term of this patent is extended or adjusted under 35 U.S.C. 154(b) by 504 days.

(21) Appl. No.: 11/301,407

(22) Filed: Dec. 13, 2005

(65) Prior Publication Data

US 2006/0091024 A1 May 4, 2006

Related U.S. Application Data

(63) Continuation-in-part of application No. 10/215,938, filed on Aug. 9, 2002, now Pat. No. 7,185,758, and a continuation-in-part of application No. 10/662,265, filed on Sep. 15, 2003, now Pat. No. 7,243,785, and a continuation-in-part of application No. 10/737,612, filed on Dec. 16, 2003, now Pat. No. 7,267,224, and a continuation-in-part of application No. 10/939,264, filed on Sep. 10, 2004, and a continuation-in-part of application No. 11/012,440, filed on Dec. 15, 2004, now Pat. No. 7,383,949.

(51) Int. Cl.
*B65D 75/00* (2006.01)

(52) U.S. Cl. ..... 206/162; 206/170; 206/427

(58) Field of Classification Search ..... 206/162, 206/167, 170, 175, 180, 187, 188, 197, 427, 206/541, 549; 229/117, 117.24; 53/443, 53/445, 474

See application file for complete search history.

(56) References Cited

U.S. PATENT DOCUMENTS 2,011,232 A 8/1935 Parks
2,026,525 A 1/1936 Korte
2,330,699 A 9/1943 Flamm
2,405,517 A 8/1946 Plummer
2,513,079 A 6/1950 Buerger
2,594,376 A 4/1952 Arneson
2,630,264 A 4/1953 Holy
2,850,223 A 8/1958 Strauss
3,123,213 A 3/1964 Kulig
3,140,036 A 7/1964 Spery
3,158,286 A 11/1964 Phillips, Jr.
3,547,339 A 12/1970 Bruce
3,576,274 A 4/1971 Stramaglis
3,661,417 A 5/1972 Inman
3,780,906 A 12/1973 Katzenmeyer
3,958,744 A 5/1976 Herglotz
4,047,610 A 9/1977 Stout et al.
4,378,880 A 4/1983 Summers
4,610,349 A 9/1986 Schwartz et al.
4,620,664 A 11/1986 Kaufman et al.
4,767,051 A 8/1988 Single (Continued)

*Primary Examiner*—David T Fidei
(74) *Attorney, Agent, or Firm*—Kramer Levin Naftalis & Frankel LLP; Gregor N. Neff

(57) ABSTRACT

A carrier is provided with vertical support panels, each with a receptacle extending outwardly from its lower region. Each receptacle has a bottom panel which unfolds partially when the folded carrier is unfolded. An engagement structure such as a detent is provided to hold each bottom panel temporarily in the partially unfolded position to hold the receptacles open until the bottom panels are pressed downwardly by an object placed in the receptacle.

16 Claims, 3 Drawing Sheets

U.S. PATENT DOCUMENTS

| | | | |
|---|---|---|---|
| 4,770,294 | A | 9/1988 | Graser |
| 4,836,367 | A | 6/1989 | Golkar |
| 4,969,595 | A | 11/1990 | Teasdale |
| 5,052,552 | A | 10/1991 | Maroszek |
| 5,320,216 | A | 6/1994 | Pangborn |
| 5,337,947 | A | 8/1994 | Eskandry |
| D367,409 | S | 2/1996 | Hunter |
| 5,695,051 | A | 12/1997 | Hart |
| 5,709,298 | A | 1/1998 | Harris |
| 5,797,486 | A | 8/1998 | Picciolo |
| 5,803,264 | A | 9/1998 | Gersten et al. |
| 5,927,502 | A | 7/1999 | Hunter |
| 6,202,836 | B1 | 3/2001 | Picciolo |
| 6,341,689 | B1 | 1/2002 | Jones |
| 6,443,308 | B1 | 9/2002 | Davis |

CARRIER AND METHOD

This patent application is a continuation-in-part of U.S. patent applications Ser. No. 10/215,938 filed Aug. 9, 2002; Ser. No. 10/662,265, filed Sep. 15, 2003; Ser. No. 10/737,612 filed on Dec. 16, 2003; Ser. No. 10/939,264 filed on Sep. 10, 2004 and Ser. No. 11/012,440 filed on Dec. 15, 2004. The disclosure of those patent applications are hereby incorporated herein by reference.

This invention relates to carriers for beverages, food, liquids in containers and other objects, and to methods of making and using such carriers.

In the above-identified prior patent applications are disclosed a number of different general-purpose carriers, and other carriers which are highly advantageous for use in carrying beverages, e.g., in "six packs" of bottles containing soft drinks, beer, etc. Other carriers are specially adapted for use in carrying both beverage cups and solid foods in sports arenas, fast-food restaurants, etc. The disclosures of those carriers hereby are incorporated herein by reference.

Although those carriers are highly advantageous, it is desired to improve the ease and reliability of the means used to hold the receptacles of the carrier open while objects are being loaded into the receptacles.

Accordingly, it is an object of the invention to provide a carrier and blank, and a method of making such a carrier, in which the receptacles of the carrier are held open surely and reliably while objects are being loaded into them.

It is another object of the invention to provide such a carrier in which the means for holding the receptacles open is relatively easy to use, and relatively inexpensive to make.

It is another object to provide such a carrier which is relatively strong and capacious, and relatively easy to unfold, and can be used with relative safety and reliability to carry cumbersome objects with a minimum of spillage.

In accordance with the present invention, the foregoing objects are satisfied by providing a carrier with a vertical support panel structure and two foldable receptacles, each extending outwardly from the lower regions of said vertical support panel structure. A bottom panel unfolds automatically as the carrier blank is unfolded in order to erect the carrier. The bottom panel fits into one of the receptacles. A side wall of the receptacle and an edge of the bottom panel have an engagement structure for temporarily holding the bottom panel and receptacle side walls stationary relative to one another to securely hold the receptacle open until an object to be carried has been loaded into the carrier.

Preferably, the engagement structure is a detent which holds the bottom panel at a position between vertical and horizontal until an object to be carried is loaded and presses down on the bottom panel to move it to a horizontal position.

Preferably, the detent includes a projection extending from one side edge of each of said bottom panels, and one side wall of each receptacle has a slot positioned to receive one of the projections during unfolding of the carrier, somewhere between the vertical and horizontal positions of said bottom panels. Preferably, the slots are located somewhere between around 10° to 80°, and, more preferably, 30° to 60° from horizontal.

It also is preferred that the engagement structure be located on what is called "the included side wall" of each receptacle; that is, on the side wall which folds onto the side wall to which the bottom panel is hinged when the carrier relapses due to the persistence of the fiberboard of which it is made. This ensures that the bottom panel will be wedged solidly into one corner of the receptacle to hold it open securely.

The foregoing and other objects and advantages of the invention will be apparent from or set forth in the following description and drawings.

IN THE DRAWINGS

FOUR-COMPARTMENT CARRIER

Figure 1:
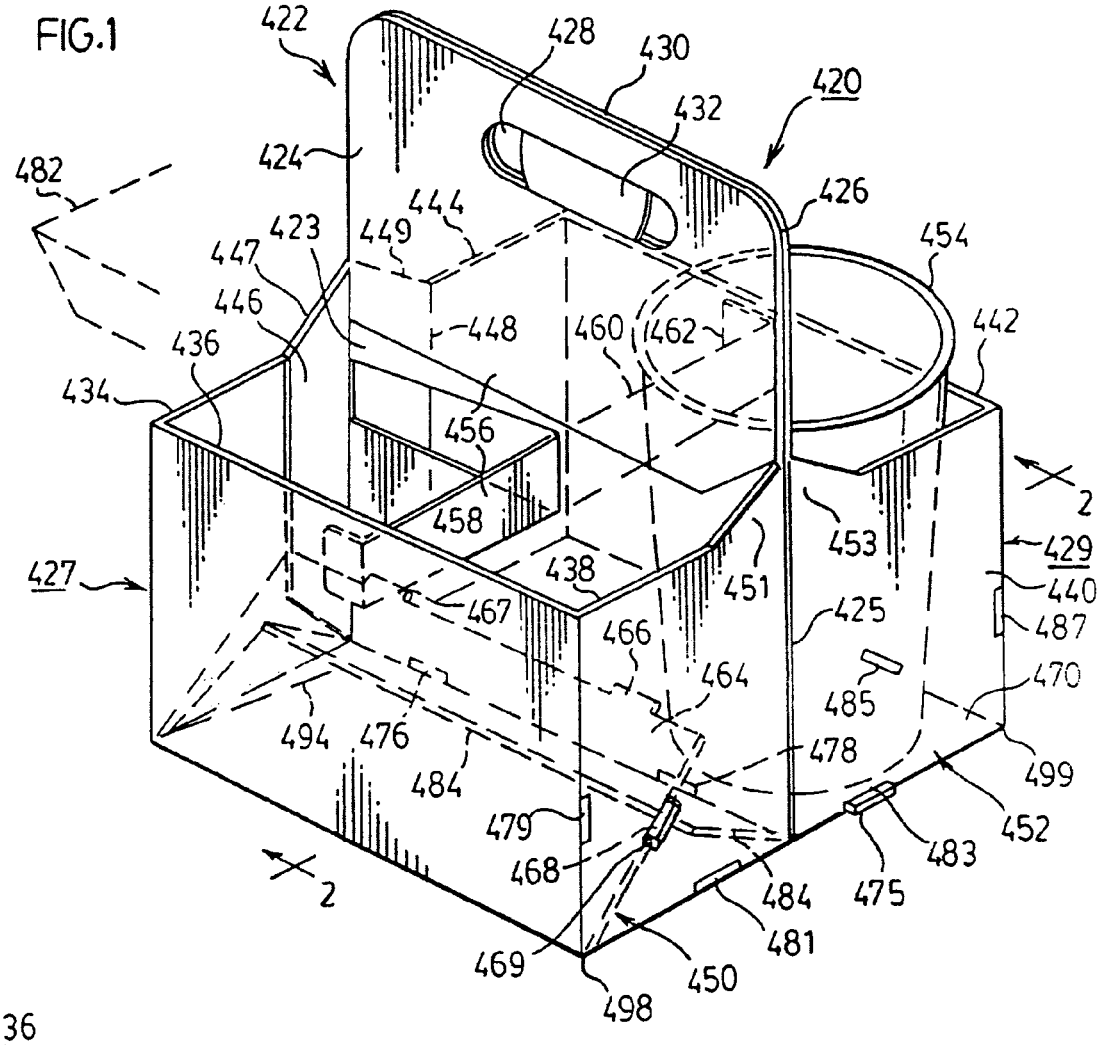
FIG. 1 is a perspective view of one embodiment of a carrier constructed in accordance with the present invention.
Figure 2:
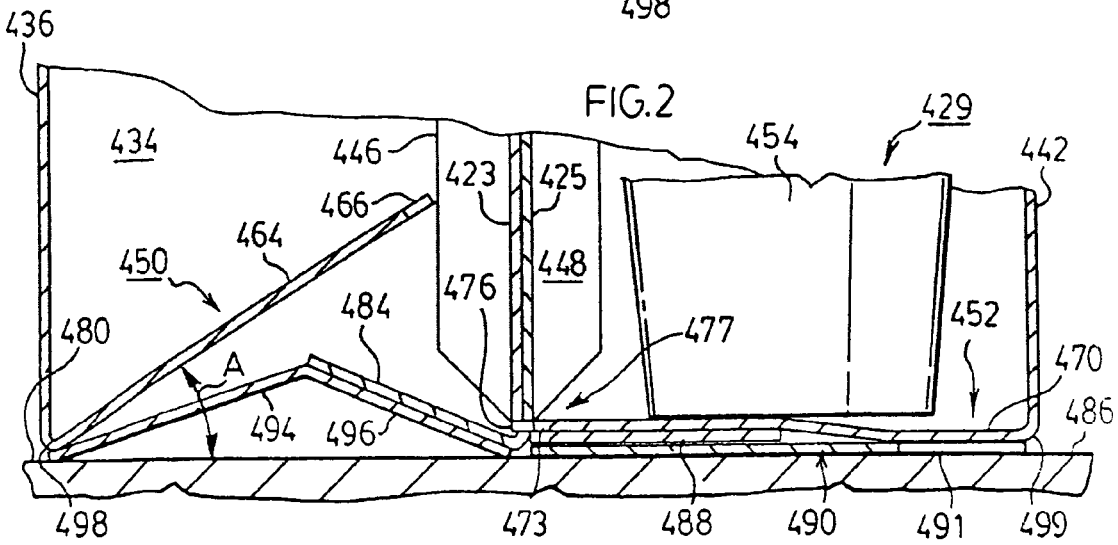
FIG. 2 is a cross-sectional, partially broken-away view taken along line 2-2 of FIG. 1.
Figure 3:
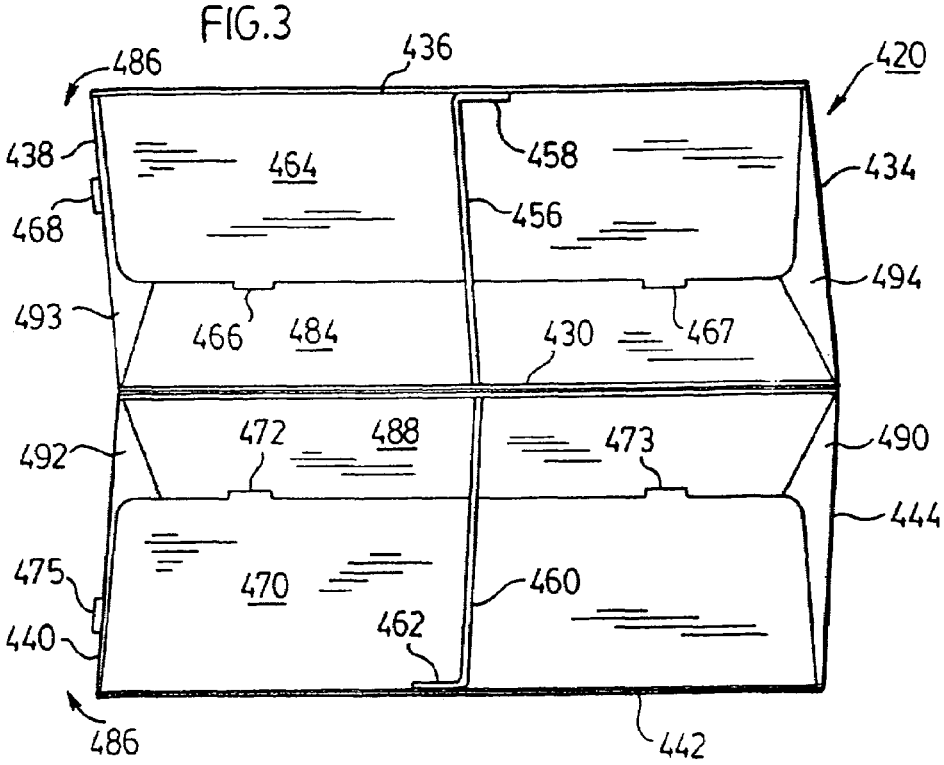
FIG. 3 is a top plan view of the carrier of FIG. 1.

FIGS. 1, 2 and 3 show a general-purpose four-compartment carrier 20 using the invention. The four compartments or receptacles can hold beverage cups, cans or bottles and a variety of other types of objects, such as potted plants, cans of motor oil or fuel additive, etc.

It should be understood that FIG. 1 also is representative of a two-compartment carrier which is not separately shown. In essence, the two-cup carrier is the same as that shown in FIG. 1 except that it is half as wide as the carrier 20 and has no dividers to divide the receptacles into four separate compartments.

The carrier 20 shown in FIG. 1 includes a central support structure 22 including two vertical support panels 23 and 25 glued or otherwise bonded together. The central support structure 22 has an upper edge 30 and a hand-hole 28 below the upper edge 30, with a foldable hand guard 32.

The upper portion of the central support structure 22 has a front surface panel 24 and a rear surface panel 26, which are bonded, respectively, to the upper areas of the panels 23 and 25, thus forming a four-ply handle structure.

A receptacle structure extends outwardly from each of the two vertical support panels 23 and 25. One receptacle 27 includes a panel folded to form the side walls 34, 36, and 38 and secured at one end to the panel 23 by a flange 46 extending from the left edge of the panel 23 and bonded to the panel 34.

Similarly, a second receptacle 29 on the opposite side of the carrier is formed by side walls 40, 43 and 44, with a flange 48 extending from the left edge of panel 25 bonded to the panel 44.

Each of the two receptacles has a bottom structure 50 or 52 including a hinged locking panel 64 or 70 (see FIG. 2) which extends completely across the bottom structure and has a pair of locking tabs 66, 67 or 72, 73 extending from its outermost edge. The tabs 66, 67 and 72, 73 fit into slots 76, 78 or 74, 77 (FIG. 4) at the bottom of the vertical support panel 23 or 25, as it is shown in greater detail in FIGS. 2 and 4.

Figure 4:
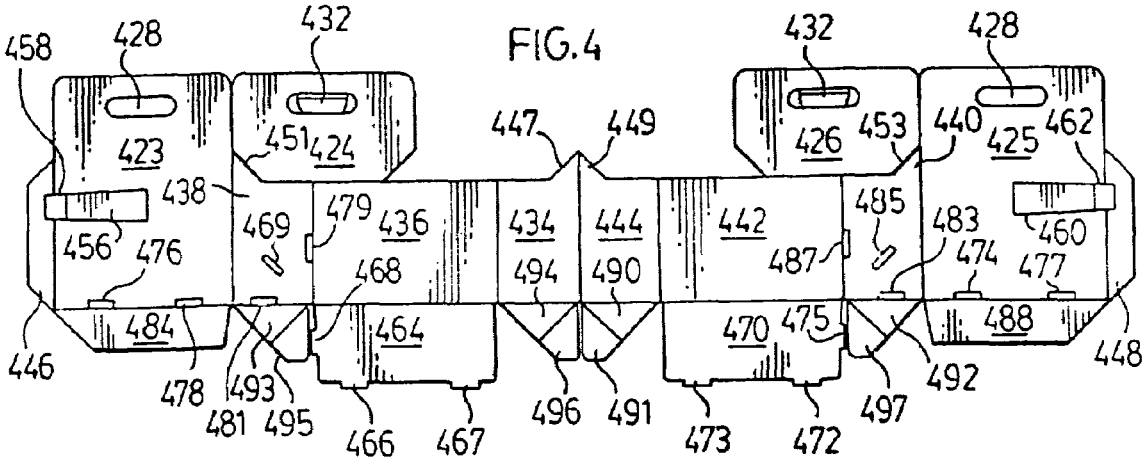
FIG. 4 is a top plan view of a blank used for making the carrier of FIGS. 1-3.

Now referring to FIG. 2, as well as to FIG. 4, each of the receptacles has a bottom support structure like most of the embodiments of the invention described in the above-identified pending patent applications, and other embodiments described herein.

FIG. 2 is a broken away cross-sectional view taken along line 2-2 of FIG. 1. The carrier shown in FIG. 1 is standing erect on a horizontal surface such as the surface 80 shown in FIG. 2. The carrier 20, which is folded and flattened when shipped, is shown in FIG. 1 after it has been partially unfolded by the simple operation to be described below.

Referring to FIG. 2, the bottom structure 50 of the left-hand receptacle 27 shown in FIG. 2 is in the position it normally takes immediately after the carrier has been unfolded and before any beverage containers or other objects have been placed in the receptacle, or before someone has pushed the panel 64 downwardly to insert the locking tabs 66, 67 into the slots 76, 78.

The right-hand receptacle 29 is shown in FIG. 2 with a full beverage cup 54 in place. The weight of the full cup has pressed down upon the panel 70 and pressed the locking tabs 72, 73 into the slots 74, 77 after the full cup has been placed into the receptacle 29.

The locking or bottom panels 64 and 70 are substantially rectangular and are almost as long as the distance between side walls 34 and 38. The substantially rectangular shape of the bottom panels 64 and 70 thus advantageously holds the receptacles 27 and 29 open so that the carrier 20 will sit erect on a horizontal surface with the receptacles 27 and 29 open so that the carrier easily can be filled with beverage cups or other objects.

As the carrier 22 is opened, the bottom panels 64 and 70 are automatically pulled downwardly approximately to an angle A such as that shown for the panel 64 in FIG. 2 by the interlocking bottom structure described in detail in my above-identified pending patent applications.

In accordance with the invention, an engagement structure is provided in each receptacle 27 and 29 as a detent to hold the bottom panel in the position shown until an object to be carried in the carrier is loaded into the receptacle.

Preferably, the detent structure comprises a tab 68 or 75 projecting outwardly from one side edge of the bottom panel 64 or 70 for each receptacle, and a slot 69 or 85 in one vertical side wall 38 or 40 of each receptacle. The slot 69 or 85 is located approximately at an angle A from the front corner 98 or 99 of the carrier, at a radial distance equal to that of the tab 68 or 75 from the hinge or fold line where the bottom panel is attached to the bottom edge of the side wall 36 or 42, so that the tab fits into the slot as the bottom panel 64 or 70 rotates about a hinge axis 98 or 99 during unfolding of the carrier. The angle A varies from about 10° to 80° from horizontal, but more preferably, it is about 30° to 60°.

With this detent structure, the bottom panel 64 or 70 remains securely in place to more surely hold the receptacle 27 or 29 open to receive objects to be carried.

When an object to be carried is pressed or dropped downwardly into one of the receptacles, the downward pressure of the object on the upper edge of the bottom panel easily disengages the tab 68 or 75 from the slot so that the bottom panel is substantially horizontal, with the lock tabs 66, 67 and 72, 73 (see FIG. 3) inserted into slots 76, 78 and 74, 77 (see FIG. 4).

In addition, two other slots 79 and 81 in side wall 38 and slots 87 and 83 in sidewall 40 provide places for the tabs 68 and 75 to extend when the bottom panels are in the folded up vertical position or the unfolded horizontal position.

The side walls 38 and 40 are referred to herein as the "included" side walls. This means that they are walls which tend to fold towards one another when the unfolded carrier tries to return or "relapse" to its folded-up starting shape.

FIG. 3 is a top plan view of the carrier 20 in its condition shown in FIG. 1. It can be seen that the side walls 38 and 40 are angled somewhat towards one another. This is due to the persistence of cardboard—that is, the tendency of the fiberboard of which the carrier is made to return to its folded condition. This tendency creates relapse forces in the directions of the arrows 86 in FIG. 3.

Preferably, the slots 69 and 85 forming the detents are formed in the included walls 38 and 40 so that the bottom panel 64 or 70 is wedged into the corner between side walls 36 and 38 or 40 and 42 which tend to collapse together due to the relapse forces of the carrier material. Thus, the bottom panels 64, 70 are held securely in the included corners of the carrier to hold the carrier receptacles open until the loading of objects into the receptacle presses the bottom panels down.

This makes the carrier easier to load, either by hand or by machine, with a high degree of reliability.

Referring again to FIG. 1, a first divider 56 with an end tab 58 adhered to the inner surface of the wall 36 divides the left-hand receptacle 27 into two compartments. Similarly, a second divider 62 with an end tab 60 bonded to the side wall 42 provides a divider for the right-hand receptacle 29.

In addition, gussets 51, 53, 47 and 49 are provided at the junctions between the side walls 38, 40, 34 and 44 and the vertical panel structure. These gussets, as well as the dividers, are optional. The gussets provide added strength for the carrier structure, if needed.

Auxiliary Tray

FIG. 1 shows an auxiliary tray 82 (broken away and in dashed lines) for optional use with the carrier 20. The tray is substantially the same as the trays shown in the above-identified patent applications. The tray has a slotted bottom through which the handle 30 and gussets 47, 49, 51 and 53 extend.

As it is explained in the above-identified pending patent applications, the tray 82 can be mounted atop the carrier 20 by inserting the handle 30 through the bottom slot of the tray 82 so that the tray can carry additional items beyond those carried in the receptacles 27 and 29.

Manufacturing Method

FIG. 4 shows the blank used to make the carrier 20, using the methods described in the above-identified patent application Ser. No. 11/012,440 filed on Dec. 15, 2004. The blank is linear with fold lines advantageously arranged for maximum utilization of material and ease of gluing and folding, as described in the pending application.

Packaged Beverage Carrier

Figure 5:
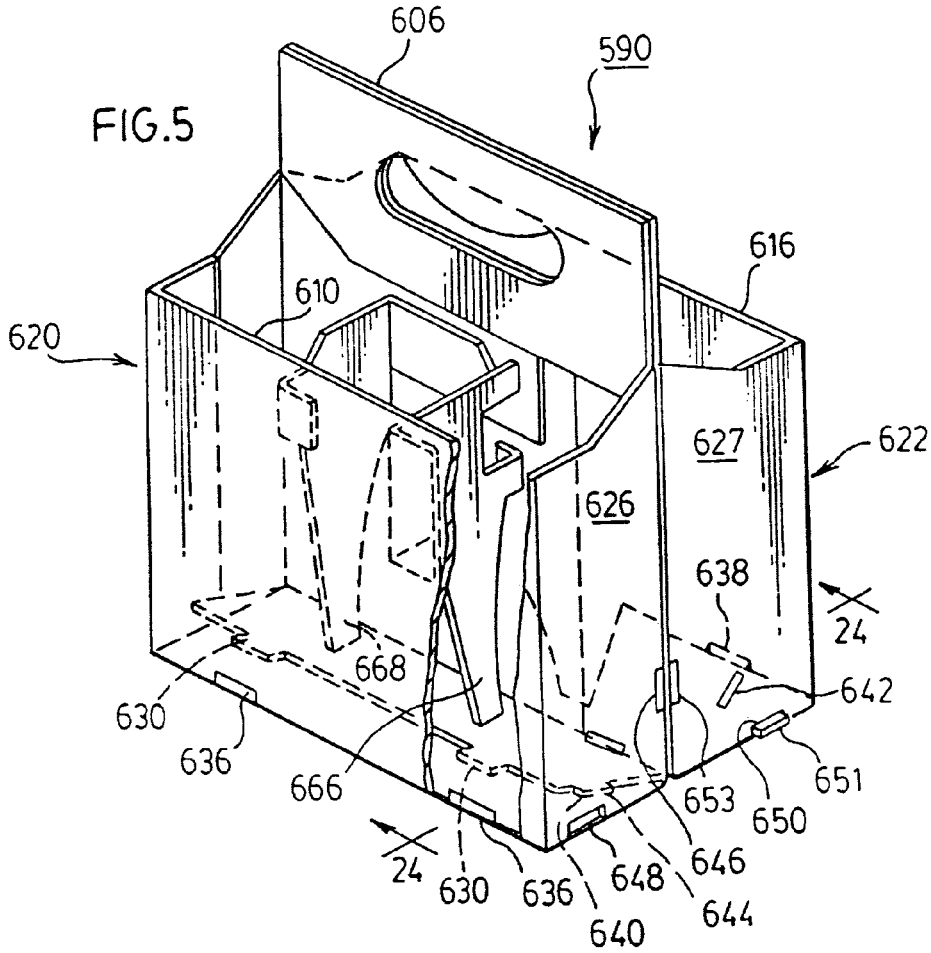
FIG. 5 is a perspective view, partially broke away, of a 6-pack carrier constructed in accordance with the present invention.
Figure 6:
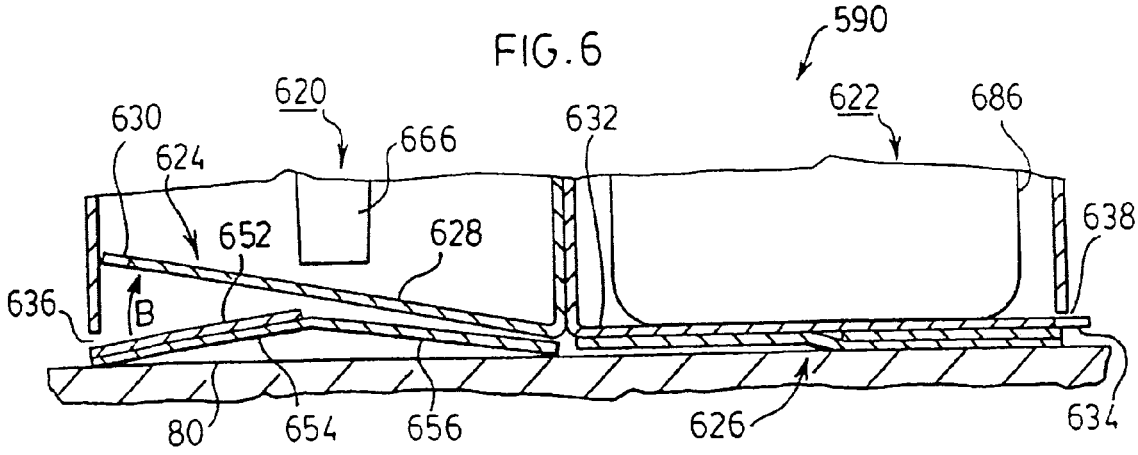
FIG. 6 is a cross-sectional, partially schematic view taken along line 6-6 of FIG. 5.

FIGS. 5 and 6 show a "packaged" beverage carrier 190 constructed in accordance with the invention. In this embodiment, the carrier 190 is a six-pack carrier, that is, one designed to hold six bottles of a soft drink, beer, water, or other beverage and preferably loaded into the carrier at a factory. It is of basically the same construction as the carrier 20 and others shown in the above-identified pending patent applications, but is specifically constructed so as to be easily filled by automatic filling equipment instead of by hand. The filled carriers then are shipped to stores.

The carrier 190 shown in FIG. 5 differs from that shown in FIGS. 1-4 also in that the carrier 190 is not as tall because there is no need for an auxiliary tray attachment, and because the carrier 190 is designed to have the same height as existing carriers which it is intended to replace.

The carrier 190 includes a vertical support structure with a handle 206, two receptacles 220 and 222, with side walls and bottom structures like those of the carrier 20.

Two dividers 266 and 268 are provided in each receptacle. The dividers extend from the central support structure and are bonded to the inside surface of a side wall of each receptacle.

Each of the dividers has a downwardly-extending tapered lower portion extending to near the bottom of the carrier in order to provide cushioning between adjacent bottles in the three compartments formed by the dividers to reduce the possibility of breakage of the bottles.

Referring now to FIG. 6, as well as FIG. 5, each of the two receptacles 220, 222 has a bottom structure 224 or 226 which is similar to one of the bottom structures shown in FIGS. 1 and 2, with one of the main differences being that the bottom panel 228 or 232 is hinged to the central vertical support structure instead of to the side wall opposite the vertical support structure.

Each of the panels 228 or 232 extends across the bottom structure and has a pair of tabs 230 or 234, each of which extends outwardly and projects through one of a pair of slots 236, 238 in the side wall panels 210 and 216 of the carriers to lock the panels in place when fully unfolded.

Each of the included end side walls 226 and 227 has a detent slot 240 or 242 for receiving a tab 244 or 251 when the bottom panel 228 or 232 is in the position of panel 228 shown in FIG. 6.

The bottom panel 228 is at an angle B with respect to horizontal. Angle B is smaller than angle A of FIG. 2 because the bottom structure 224 is designed to bring the panel 228 to that position before full unfolding in order to clear the dividers 266, 268 to the extent necessary to prevent unwanted bending of the parts during unfolding.

The detent structures consisting of the slots 240, 242 and tabs 244 and 251 hold the carrier receptacles open in the same manner as described above with respect to FIG. 1-4. The slots 246, 248, 250 and 253 serve the same function as the similarly placed slots when in FIGS. 1 and 4.

The carrier 190 is shown in FIG. 6 with a full beverage bottle 286 which has been dropped or pressed downwardly into the partially open carrier to depress the panel 232 to the position shown.

It should be noted that the bottom panels in the carriers can be hinged either from the bottom edges of the vertical central support panels or from the opposite side wall. The choice of which construction to use depends on other construction features desired, such as nesting, etc.

Materials

The materials of which the carrier of the present invention can be made need not be expensive. Ordinary, medium-weight fiberboard is believed to be sufficient for most purposes. For example, it can be 0.20 S.U.S. recycled newspaper material. If waterproofing beyond the acrylic coating provided on such board is necessary, a further waterproof coating can be applied on both the inside and outside surfaces.

It is within the realm of the invention also to make the carriers out of flexible plastic materials.

If desired, the carriers can be made of plastic materials that are easily washable so that the carriers can be reused.

Bonding of parts to one another can be done by means other than adhesives. For example, plastic or plastic coated parts can be bonded together by ultrasonic or heat bonding. Staples or other mechanical fasteners also can be used.

The above description of the invention is intended to be illustrative and not limiting. Various changes or modifications in the embodiments described may occur to those skilled in the art. These can be made without departing from the spirit or scope of the invention.

What is claimed is:

1. A carrier comprising:

a vertical support structure having at least one vertical support panel;

at least one foldable receptacle secured to and foldable flat against said vertical support panel, said receptacle having vertical side panels, a vertical front panel foldably secured to said vertical side panels, and a bottom panel having a hinge edge and another edge opposite said hinge edge, and a pair of opposed side edges transverse to said hinge edge and said other edge;

said bottom panel being hinged at said hinge edge to one of said vertical front panel and said vertical support panel to rotate between a vertical folded position and a horizontal unfolded position;

said bottom panel being shaped and sized so that at least one of said side edges of said bottom panel engages one of said vertical side panels as it is being unfolded; and an engagement structure for causing said one side edge of said bottom panel to engage with said one vertical panel to hold said bottom panel in a position intermediate a horizontal and a vertical position until and object is loaded into said receptacle.

2. A carrier as in claim 1 in which said engagement structure is a detent structure.

3. A carrier as in claim 1 in which said engagement structure comprises a tab extending from said one side edge in said one vertical side panel positioned to engage with said tab as said bottom panel is being unfolded.

4. A carrier as in claim 1 in which said one vertical side panel is an included panel.

5. A carrier as in claim 1 in which said one vertical side panel folds so as to lie flat and overly said vertical support panel when said receptacle is folded.

6. A carrier as in claim 1 in which said vertical support structure includes a second vertical support panel secured back-to-back to the first-named vertical support panel, and a second foldable receptacle secured to and folded flat against said second vertical support panel, said second receptacle having the same structural elements as the first-named receptacle.

7. A carrier as in claim 6 in which said vertical support structure has a hand-hold in its upper portion for use in carrying said carrier, said receptacles being attached to said vertical support panels in the lower portions thereof, with a substantial portion of each vertical support panel extending above said receptacles, and a tray structure placed upon said upper portion to form a third receptacle for items to be carried.

8. A carrier as in claim 7 in which each of said receptacles has dividers therein to form two or more separate beverage container holder compartments.

9. A carrier as in claim 1 in which said engagement structure is located at a position angularly spaced away from the unfolded position of said bottom panel at an angle of from about 10° to 30° to about 60° to 80°.

10. A carrier comprising:

a vertical support structure having first and second vertical support panels secured together;

a pair of foldable receptacles, each secured to and foldable flat against one of said vertical support panels;

each of said receptacles having vertical side panels and a front panel foldably secured to said vertical side panels;

a bottom panel having a hinge edge and another edge opposite said hinge edge, and a pair of opposed said edges transverse to said hinged edge and said other edge;

said bottom panel being hinged at said hinge edge to one of said front panel and said vertical support panel to pivot between a vertical folded position and a horizontal unfolded position when said carrier is being unfolded;

said bottom panel being shaped and sized so that at least one of said side edges of said bottom panel engages one of said vertical side panels of said receptacles as it is being unfolded;

said one side edge of said bottom panel having a tab projecting therefrom;

said one vertical side panel having a slot for receiving said tab;

said one vertical side panel being an included panel; and said slot extending along a radius from the pivot point of said bottom panel at said hinge edge;

said slot being located at an angle of from approximately 10° to 30° to approximately 60° to 80° from the plane of said bottom panel when it is fully unfolded.

11. A method of packaging beverage containers in carriers, said method comprising the steps of:

(a) providing a vertical support structure having at least one vertical support panel;

at least one foldable receptacle secured to and foldable flat against said vertical support panel, said receptacle having vertical side panels, a vertical front panel foldably secured to said vertical side panels, and a bottom panel having a hinged edge and another edge opposite said hinged edge, and a pair of opposed side edges transverse to said hinge edge and said other edge;

said bottom panel being hinged at said hinge edge to one of said vertical front panel and said vertical support panel to rotate between a vertical folded position and a horizontal unfolded position;

said bottom panel being shaped and sized so that at least one of said side edges of said bottom panel engages one of said vertical side panels as it is being unfolded; and an engagement structure for causing said one side edge of said bottom panel to engage with said one vertical panel to hold said bottom panel in a position intermediate a horizontal and a vertical position until and object is loaded into said receptacle; and (b) loading a beverage in a container into said receptacle by placing it into said receptacle and driving said bottom panel downwardly to disengage said engagement structure and position said bottom panel at the bottom of said receptacle.

12. A method as in claim 11 including the step of mounting a third receptacle on said vertical support structure and placing objects in said third receptacle.

13. A method as in claim 12 in which said third receptacle has a bottom wall and side walls extending upwardly therefrom, and a slot in said bottom wall of said third receptacle shaped and sized to receive therethrough the upper portion of said vertical support structure, said upper potion having a hand-hole for carrying said first, second and third receptacles with one hand.

14. A method as in claim 11 in which said providing step includes locating said engagement structure on said one vertical side panel at a location where said one said edge of said bottom panel will meet with said engagement structure when said carrier is being unfolded to erect it.

15. A method as in claim 14 in which said engagement structure is a detent consisting of a tab extending from said one side edge of said bottom panel and a slot in said vertical side panel dimensioned to receive said tab therein.

16. A method as in claim 11 including the step of pushing towards one another opposed edges of said carrier, said carrier having a bottom structure for pulling said bottom panel downwardly to rotate it about one edge in response to said pushing force and thereby move it into engagement with said engagement structure.

* * * * *